US006848806B2

(12) United States Patent
Yoshida et al.

(10) Patent No.: US 6,848,806 B2
(45) Date of Patent: Feb. 1, 2005

(54) INDIRECTOR LIGHT FIXTURE

(75) Inventors: Michael K. Yoshida, Monmouth Junction, NJ (US); Thomas Russello, Freehold, NJ (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/453,217

(22) Filed: Jun. 3, 2003

(65) Prior Publication Data

US 2003/0227772 A1 Dec. 11, 2003

Related U.S. Application Data

(60) Provisional application No. 60/386,149, filed on Jun. 5, 2002.

(51) Int. Cl.[7] ..... F21S 8/00

(52) U.S. Cl. ..... 362/147; 362/269; 362/371; 362/418; 362/427

(58) Field of Search ..... 362/145, 147, 362/260, 269, 285, 289, 370, 371, 418, 419, 427

(56) References Cited

U.S. PATENT DOCUMENTS

| | | | | |
|---|---|---|---|---|
| 3,778,610 A | * | 12/1973 | Wolf | 362/418 |
| 5,690,419 A | * | 11/1997 | Siems | 362/269 |
| 5,722,770 A | * | 3/1998 | Douglas | 362/285 |
| 6,059,424 A | * | 5/2000 | Kotloff | 362/220 |
| 6,517,216 B1 | * | 2/2003 | Cercone et al. | 362/220 |

* cited by examiner

*Primary Examiner*—John Anthony Ward
(74) *Attorney, Agent, or Firm*—John F. Salazar; James E. Cole; Middleton Reutlinger

(57) ABSTRACT

An indirector light fixture is described wherein the fixture is comprised of a reflector housing and a ballast housing connected together by a support arm. The reflector housing may be positioned relative to the ballast housing by movement of the support arm and maintained therein by a ratchet and pawl mechanism or other rotational restriction device. The ballast housing and ballast electronics are connected to the lamp within the reflector housing by ballast feed wires which are maintained internal of the entire fixture thereby preventing the wires from becoming entangled during installation or after installation. Additional structure is provided to further allow adjustment of the head angle relative to the ballast housing.

23 Claims, 11 Drawing Sheets

INDIRECTOR LIGHT FIXTURE

CROSS REFERENCE TO RELATED APPLICATIONS

This is a utility application of provisional application filed Jun. 5, 2002, Ser. No. 60/386,149.

BACKGROUND OF THE INVENTION

Field of the Invention

The present invention is directed towards an indirector light fixture for either ceiling or wall mount which is easily adjustable into position.

SUMMARY OF THE INVENTION

One aspect of the present invention is to provide an indirector light fixture which may be readily mounted on either a vertical or horizontal ceiling surface.

A further aspect of the present invention is to provide an indirector light fixture which has a light fixture head attached to a ballast housing wherein the fixture head is easily adjustable relative to the ballast housing.

A further aspect of the present invention is to provide a light fixture head or reflector housing which is rotatable about a hinge pin affixed to a ballast housing, the light fixture head being automatically adjustable through a ratchet and pawl mechanism for support and adjustment relative to the ballast housing.

A further aspect of the present invention is to provide an indirector light fixture wherein the ballast housing and the light fixture head are electrically connected through ballast feed wires, the ballast feed wires being hidden from view.

An additional aspect of the present invention is to provide a light fixture head wherein a reflector is based, the reflector surrounding a lamp and being adjustable in order to provide a secondary adjustment mechanism for light direction adjustment.

An additional aspect of the present invention is to provide an indirector light fixture wherein the light fixture head or reflector housing has a ratchet and pawl mechanism for support of the light fixture head relative to the ballast housing and wherein the fixture head and support arm will travel in increments thereby locking the fixture head in place to support the fixture head through a ratchet and pawl mechanism or other supporting device inter-connected between the fixture head and the ballast housing.

These and other objects of the invention are accomplished with the indirector light fixture of the present invention. The indirector light fixture of the present invention has a ballast housing and fixture head or reflector housing which is attached together such that the reflector housing may be supported relative to the ballast housing. The reflector housing may be attached to the ballast housing by a support arm which may have a pivot point relative to both the reflector housing and the ballast housing. Additionally, the support arm may be provided with a ratchet and pawl mechanism for allowing adequate support of the reflector housing in a stable position.

The indirector light fixture of the present invention surrounds a lamp with a position adjustable reflector which provides a secondary adjustment mechanism for positional direction of the light emitted by the lamp. The adjustable reflector within the reflector housing or lamp head may be readily accessible and easily adjustable in addition to the ratchet and pawl adjustment mechanism provided for positioning of the reflector housing relative to the ballast housing.

The present invention is therefore directed towards an indirector light fixture which has a ballast housing and a reflector housing or lamp head affixed thereto, the reflector housing being adjustable relative to the ballast housing and supported in a predefined position by a ratchet and pawl adjustment mechanism which allows for adjustment and support of the reflector housing relative to the ballast housing in predefined increments and preventing downward rotation. The indirector light fixture of the present invention additionally provides a mechanism for electrical connection between the reflector housing and the ballast housing without having external ballast feed wires while still allowing relative movement between the ballast housing and the reflector housing. Additionally, the indirector light fixture of the present invention provides a secondary adjustment mechanism for the direction of light emitted from the reflector housing by direct adjustment of the reflector within the reflector housing.

These and other objects of the present invention are met by the indirector light fixture described herein. However, many other objects of the invention and various aspects of the present invention may be interpreted from the teachings herewith and no unnecessary limitations are to be construed from the specific aspects or objectives outlined herein without also taking into consideration the entire specification, claims and drawings which are a part hereof.

BRIEF DESCRIPTION OF THE DRAWINGS

A better understanding of the invention will be had upon reference to the following description in conjunction with the accompanying drawings and which, like numerals, refer to like parts throughout the several views and wherein.

DETAILED DESCRIPTION OF THE PREFERRED EMBODIMENT

Figure 1:
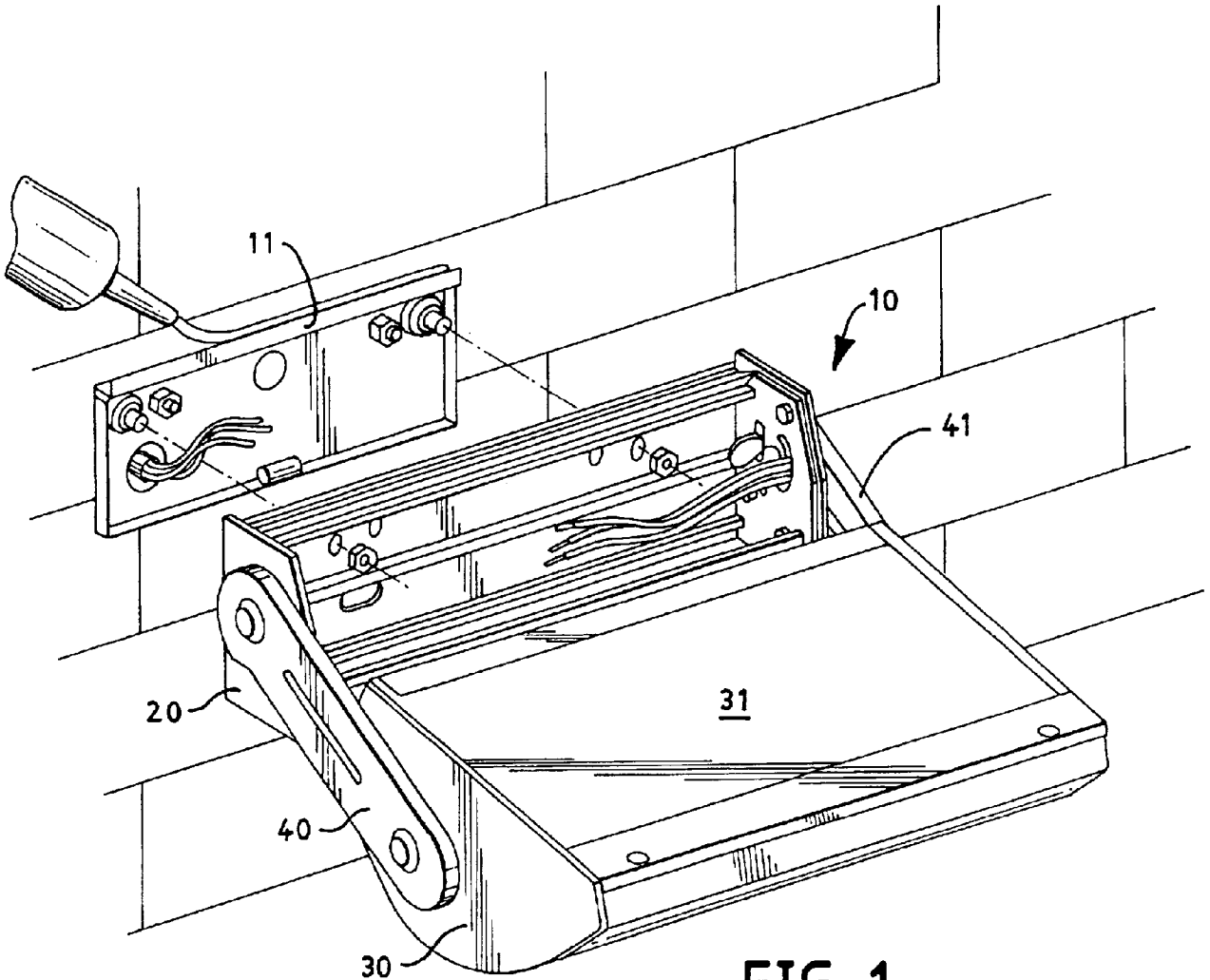
FIG. 1 is a perspective view of the indirector light fixture of the present invention partially disassembled from the wall mount plate.

The indirector light fixture 10 of the present invention is depicted in FIG. 1. As shown therein, the reflector housing or fixture head 30 is held outward from a ballast housing 20 by support arms 40, 41. The ballast housing 20, as shown in FIG. 1, may be affixed to a vertical surface, such as a wall, by a ballast house mount plate 11 which will allow the ballast housing to mount to the wall or, alternatively, to a ceiling.

As shown in FIG. 1, the indirector light fixture 10 of the present invention has a mount plate 11, ballast housing 20, reflector housing 30 and a lens cover 31. Within the ballast housing are the ballast and other electronics necessary for providing adequate electrical current to the lamp 33 contained within the reflector housing 30. As is typically the case, the ballast electronics contained within the ballast housing are separated from the lamp within the reflector housing 30 such that the heating characteristics of the two elements remain separate and therefore do not cause overheating conditions. However, alternative electrical connection and assemblies may be utilized while also incorporating the various features of the present invention and the specific electrical connections as well as electrical configurations depicted herein should not be considered limiting. As such, the present invention covers such alternative connections and assembly constructs such as combination ballast electronics and lamp electronics.

As further shown in FIG. 1, it is apparent that the support arms 40, 41 may rotate about a hinge or pivot point on one or both of the ballast housing 20 and the reflector housing 30. This allows for accurate adjustment of the lens and reflector housing 31, 30 such that the ballast housing and mount plate, when mounted to either a vertical or horizontal surface, may not negatively impact the direction of the light output from the lamp and reflector housing.

Figure 2:
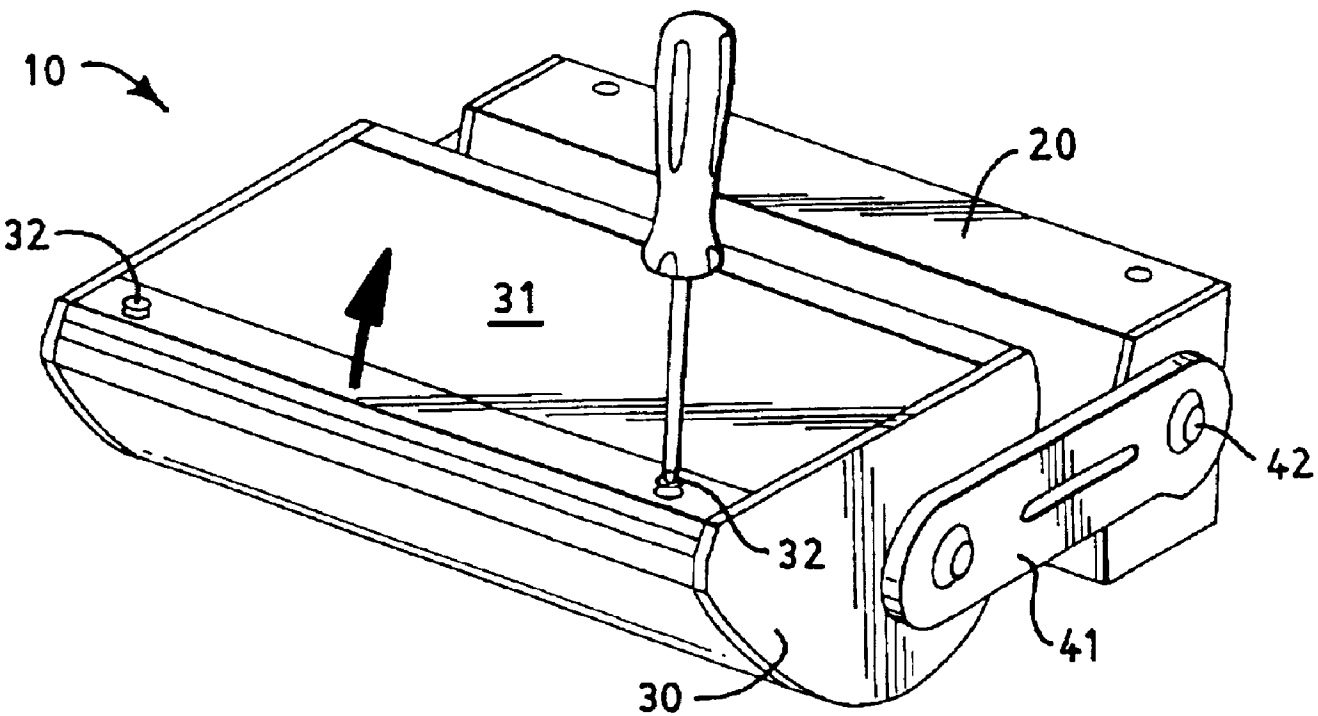
FIG. 2 is a perspective view of the indirector light fixture of the present invention.
Figure 3:
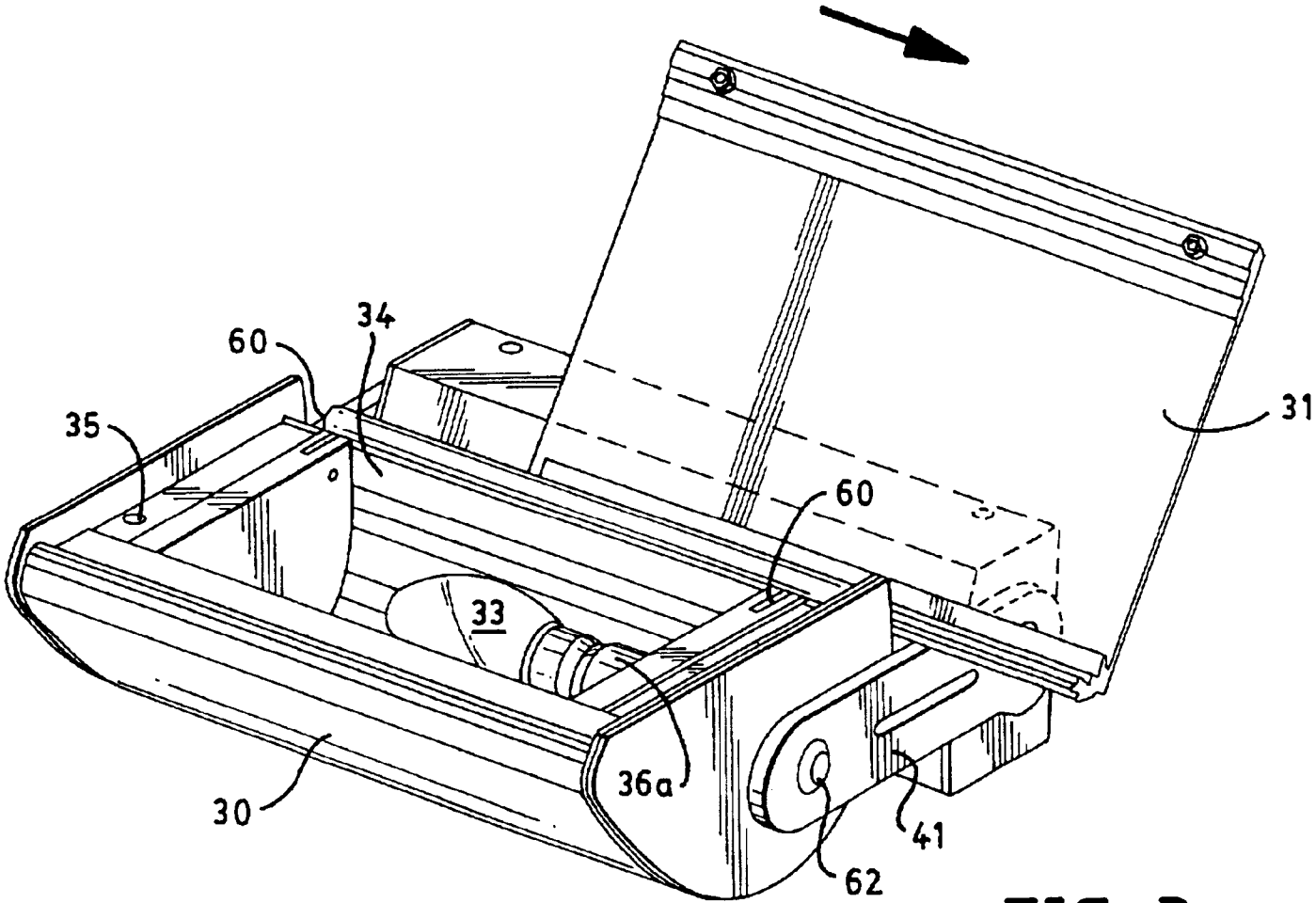
FIG. 3 is a perspective view of the indirector light fixture of the present invention with the lens partially removed.

As shown in FIG. 2 and in FIG. 3, access to the interior of the reflector housing 30 may be accomplished by loosening of the lens attachment screws 32. After removal of the screws 32, the lens may be raised thereby exposing the interior of the reflector housing 30 as depicted in FIG. 3. As depicted in both FIG. 2 and FIG. 3, removal of the lens attachments screws 32 allows the lens to be raised and then slid outward from the rear portion of the reflector housing. The reflector housing 30 may therefore be exposed allowing access to the interior of the housing and exposing the lamp socket 36*a* and lamp 33. Such access may be desirable for servicing of the indirector light fixture 10, replacement of the lamp 33 or adjustment of the reflector 34 contained within the reflector housing 30.

Lamp 33 may be a high intensity discharge (HID) lamp in order to increase the output luminosity of the indirector light fixture 10 of the present invention. Of course, other lamps or light emission device may be utilized within the reflector housing 30 of the present invention such as ARC lamps, compact fluorescent or other light sources.

Figure 4:
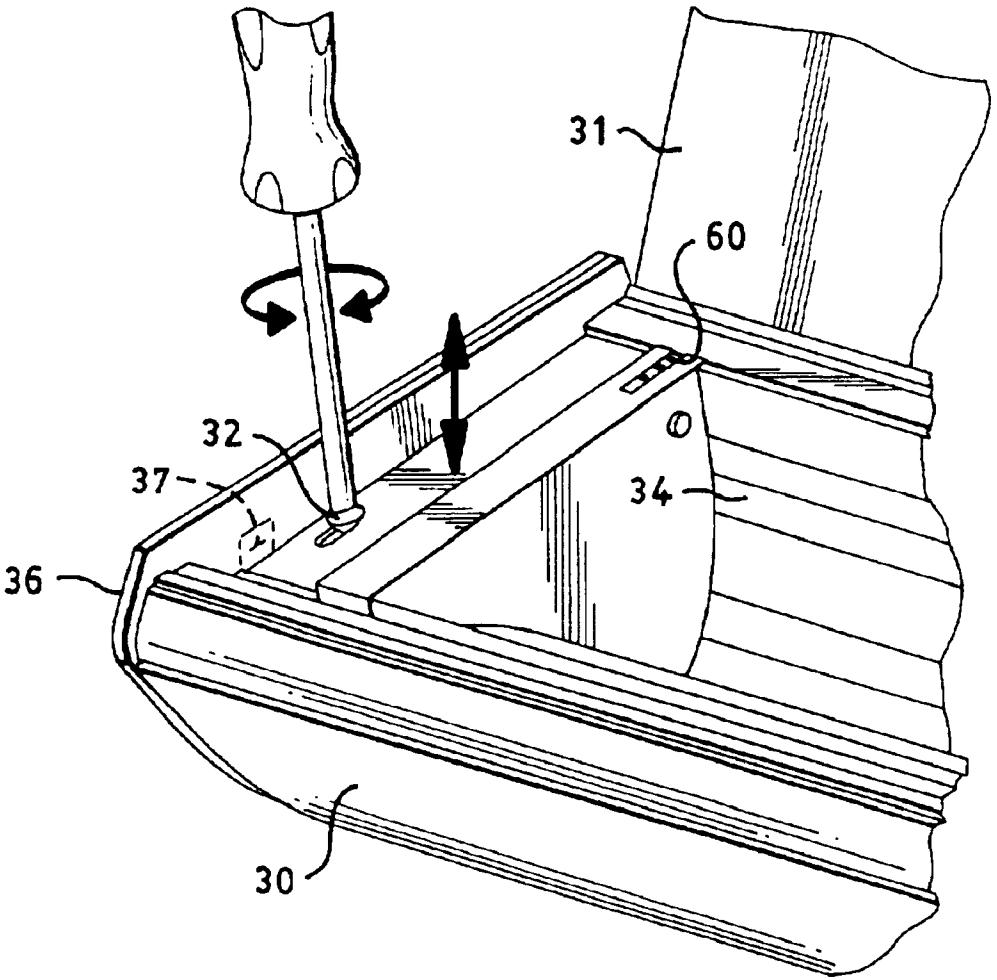
FIG. 4 is a close up perspective view of the reflector assembly adjustment mechanism of the present invention.

As shown in combination with FIG. 3 and FIG. 4, the reflector 34 retained within the reflector housing 30 may be adjustable. The reflector 34 may be hingedly affixed to a rear portion of the reflector housing 30 by hinge members 60 such that the reflector 34 may be adjusted within the reflector housing. As shown in FIG. 3 and FIG. 4, the reflector housing may be adjusted by the reflector adjustment screws 35 placed along the forward or front portion of the side of the reflector 34. As can be seen in conjunction with the exploded view of the light fixture in FIG. 6, the adjustment screws 35 retain the reflector within the reflector housing at a desired angle by biasing the reflector upward through the use of reflector bias springs 35*a* which force the reflector upward against the head of the reflector screws 35 in combination with the hinges 60. As such, as depicted in FIG. 4 and FIG. 3, the reflector may be adjusted internally of the reflector housing by either tightening or loosening the reflector screw 35.

Further, as shown in FIG. 4, along the inner side wall of the reflector housing side wall 36 are the reflector angle markings 37 which allows the user to adjust the internal reflector to a predefined angle of deflection. As shown in the figures, the reflector 34 may be field adjusted upwards or downwards for customer desired light distribution. A deflection of up to 10° may be provided utilizing the adjustment screws 35 but increased deflection may be accomplished by increasing the adjustment screw length 35 in combination with the biasing springs 35*a*.

Figure 6:
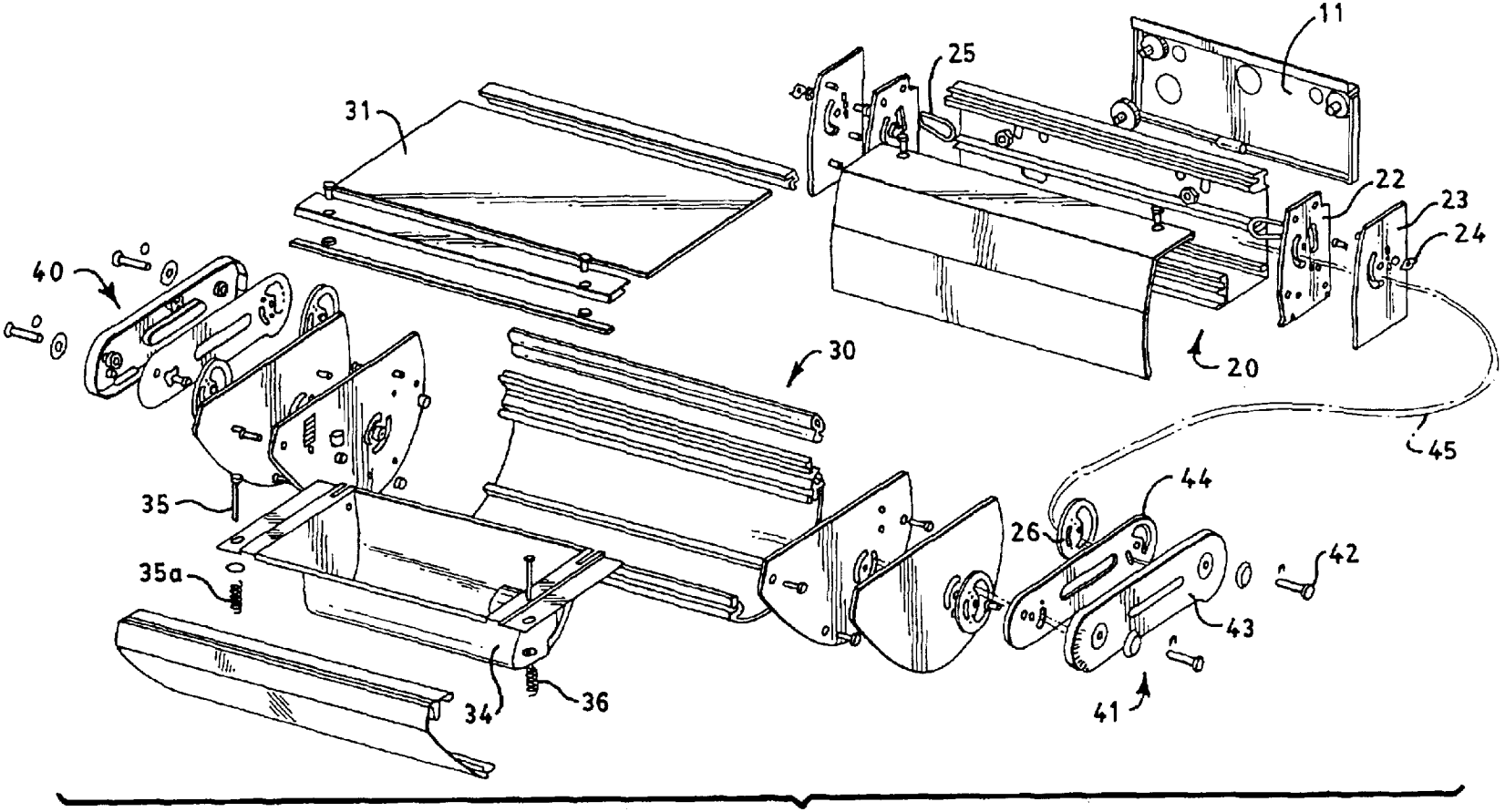
FIG. 6 is an exploded view of the indirector light fixture of the present invention.

As shown in the figures, the internal reflector 34 may be adjusted about the hinges 60 thereby causing deflection of the light without movement of the reflector housing 30 or support arms 40 and 41. Thus, the reflector adjustment screws 35 provide an alternative means for adjustment of the internal reflector 34. As can be seen in FIG. 6, the reflector adjustment screws 35 extend through the apertures in the sides of the reflector 34 and extend downward into threaded openings within the reflector housing 30. Interposed therebetween are the biasing springs 35*a* thereby forcing upward bias against washers and, concurrently, the underside of the frame of the reflector 34 thereby causing the reflector 34 to rotate about hinge members 60. Markings 37 can provide an indication as to the degree to which the reflector is adjusted relative to the flat horizontal plane defined by the top of the reflector housing 30 and lens 31. Of course, if the reflector housing 30 is not at a level position due to the adjustment of the support arms 40 and 41, additional measurements may be necessary in order to properly position the reflector 34 to the desired angular displacement.

Figure 5C:
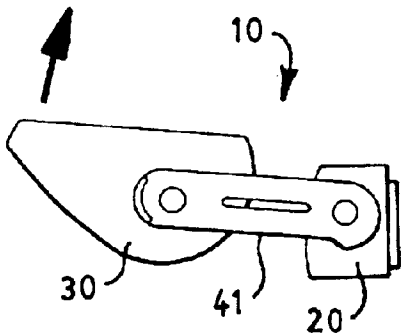
FIGS. 5*a*–5*c* is a side view of the indirector light fixture of the present invention in the various stages of adjustment using the support arm.
Figure 5B:
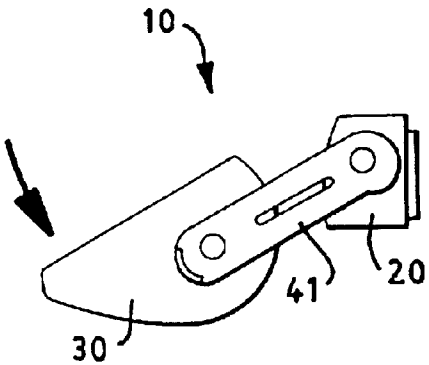
Figure 5A:
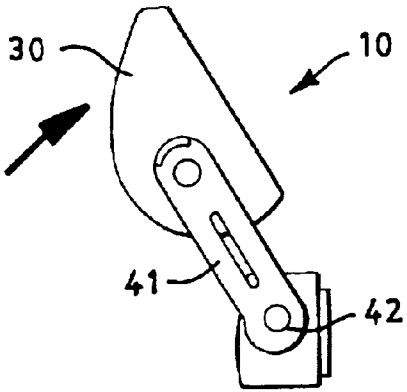

Turning to FIGS. 5–10, an alternative mechanism for adjusting the reflector housing and the support arm angle is provided within the support arms and ballast housing connection. As shown in FIG. 5 wherein a single side of the indirector light fixture 10 of the present invention is depicted, the support arm may be positioned relative to the mounted ballast housing 20 such that the reflector housing 30 is properly positioned to a desired level. FIG. 5 depicts only a single support arm but both support arms may incorporate the ratchet and pawl mechanism described herein. As shown in the figures, the support arm 41 may be adjusted to a desired angle relative to the ballast housing 20. The support arm 41, which supports the reflector housing 30 relative to the ballast housing 20 as the ballast housing 20 is mounted to a wall or ceiling, maintains the reflector housing 30 in a supported position preventing the downward travel of the reflector housing about the hinge pin 42. The support arm 41 is maintained in the supported position by a ratchet and pawl mechanism integrated into the support arm 41 and the ballast side wall 22 and support plate 23. The ratchet and pawl mechanism will allow for the upward or clockwise rotation of the reflector housing 30 about hinge pin 42 while preventing downward travel or counter clockwise travel about hinge pin 42. The design of the ratchet and pawl integrated within the support arm 41 will therefore allow for adjustment of the support arm angle upward and lock the reflector housing in place while allowing upward travel at 15° increments. Various incremental displacements from the ballast housing 20 may be provided For example, if the ballast housing is mounted along a vertical wall as depicted, the ratchet and pawl mechanism may allow for support from 30° downward from a horizontal plane to 60° up from the same horizontal plane. As depicted in FIGS. 5*a*–5*c*, various aspects of the ratchet and pawl construction within the support arm 41 are provided. As will be described herein within the ratchet and pawl assembly, the reflector housing can be raised to its upright position as depicted in FIG. 5*a* to release the pawl from the ratchet teeth thereby allowing for downward travel and resetting of the fixture head and any desired position within the increments supported as is shown in FIGS. 5*b* and 5*c*.

Figure 7:
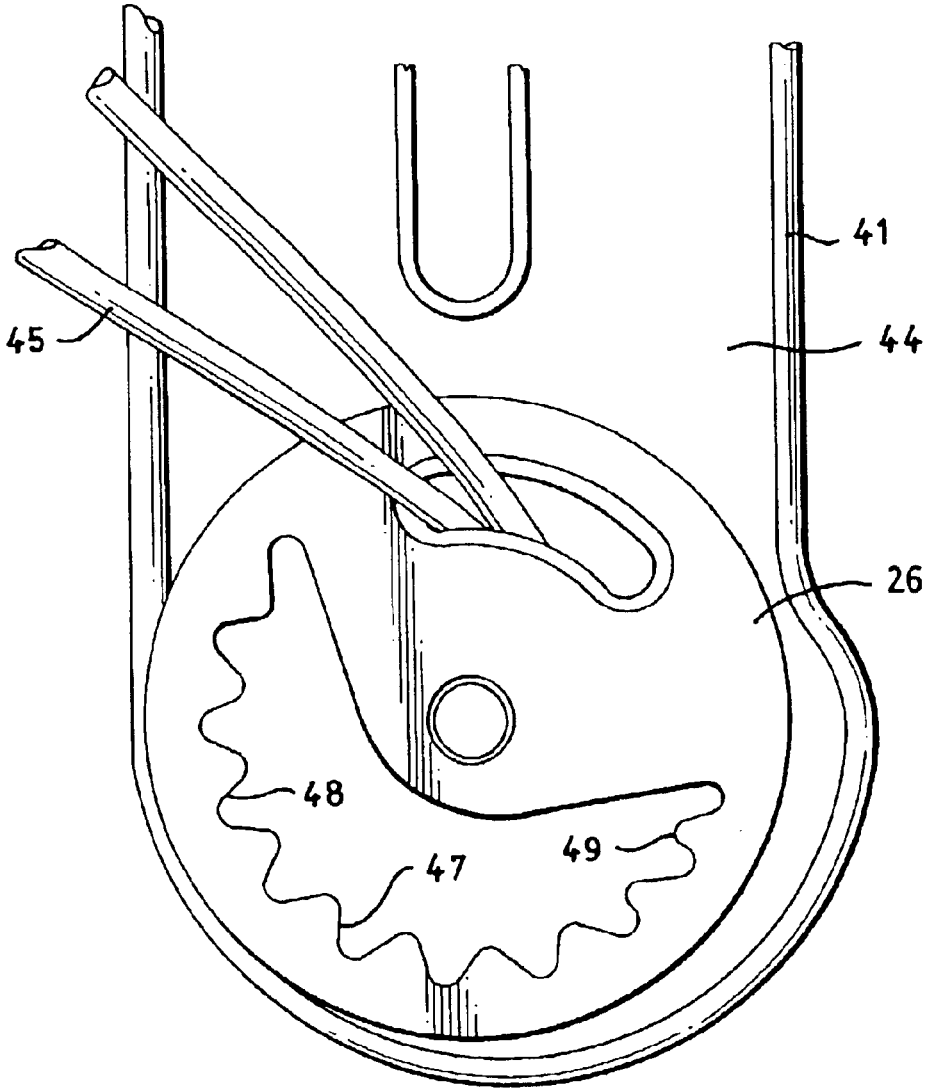
FIG. 7 is a close up view of the support arm ratchet teeth of the present invention.

As shown in conjunction with FIGS. 6, 7, 8 and 9, the support arm 41 has formed therein a first distal end ratchet teeth 47 as depicted in FIG. 7. The support arm 41, as seen in FIG. 6, is comprised of inner plate 44 and outer plate 43 with sliding cover 26 positioned between the inner plate 44 and support mount plate 23. Support arm 41 has formed a plurality of ratchet teeth 47 which work in combination with a pawl residing on the outer surface of support mount plate 23. The pawl 24 works in conjunction with the ratchet teeth to prevent downward or counter clockwise travel of the support arm and reflector housing about pin 42. As can be seen in conjunction with FIGS. 7, 8, 9 and 10, the ratchet and pawl design integrated within the support arm 41 and support mount plate 23 allows the reflector housing to be positioned at a desired level while supporting the reflector housing 30 in a desired position.

As seen in FIG. 7, the ratchet teeth 47 are positioned along an interior surface of the support arm 41. As previously indicated, the inner plate 44 and outer plate 43 of the support arm 41 forms a hollow area therebetween thereby creating the opening within which the ratchet teeth 47 are formed. The ratchet teeth work in conjunction with the open or reset position 48 within the teeth as well as the closing ratchet 49 which are designed to position the pawl 24 in a desired orientation relative to the ratchet 47.

As indicated, the desired functionality of the ratchet and pawl mechanism integrated design set forth within the support arm 41 and support mount plate 23 is such that the pawl 24 prevents downward or counter clockwise rotation about hinge pin 42. However it is desirable that the reflector housing 30 may be rotated clockwise about the hinge pin 42 and allows proper support of the reflector housing 30 thereby preventing counter clockwise rotation. Additionally it is desired that the ratchet and pawl mechanism allow the pawl 24 to be reset so that when the reflector housing and support arm are positioned at its upper most position as depicted in FIG. 5*a*, the pawl 24 is placed in an inactive position thereby preventing the pawl tooth 39, shown in FIG. 8, from engaging the ratchet teeth 47 on support arm 41. Thus, when the reflector housing 30 and support arm 41 are positioned as depicted in FIG. 5*a*, the pawl is forced into the unengaged position shown in FIG. 8 thereby preventing the pawl tooth 39 from engaging the ratchet teeth 47. In such a position when the reflector housing is positioned to reset the ratchet and pawl mechanism, the pawl tooth 39 is positioned within the open reset position 48 causing the pawl tooth 39 to disengage the ratchet teeth 47. Pawl bias clip 25, shown in the figures, retains the pawl in the desired position by having first clip end 29 and second clip end 28 maintain the pawl in the proper orientation. Thus, as depicted in FIG. 8, the pawl 24 is maintained in the unengaged position thereby preventing the pawl tooth 39 from engaging the ratchet teeth 47.

Figure 8:
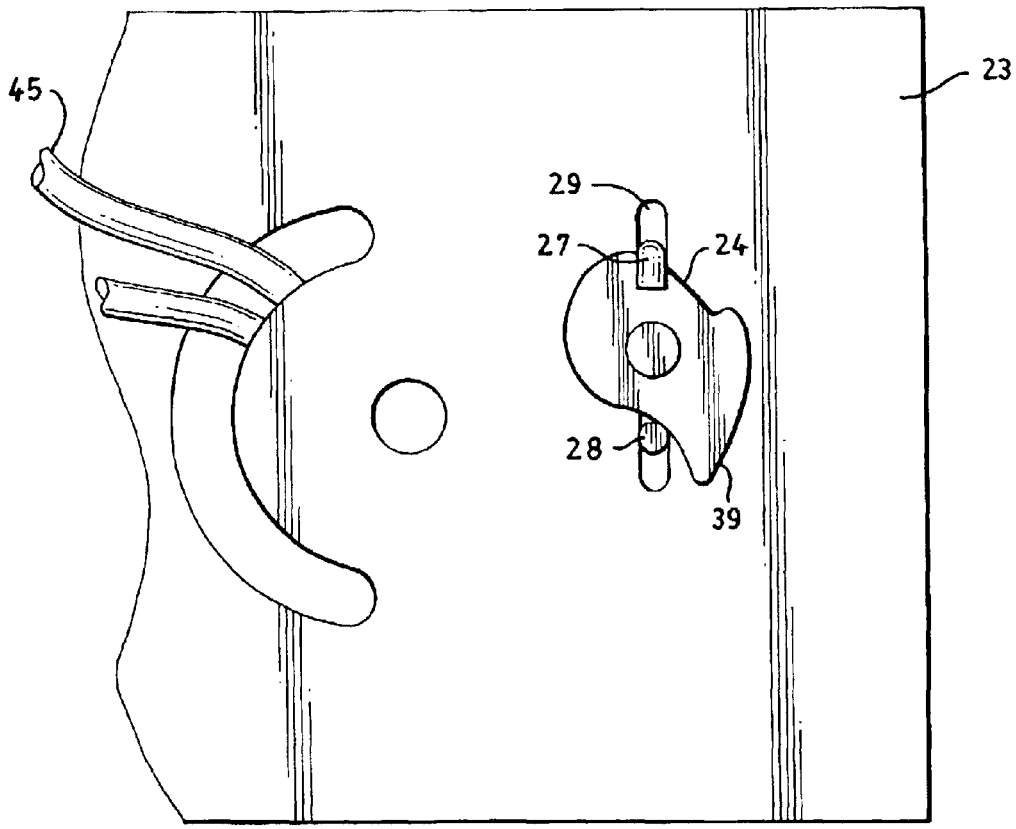
FIG. 8 is a close up view of the pawl assembly on the side of the ballast housing.
Figure 9:
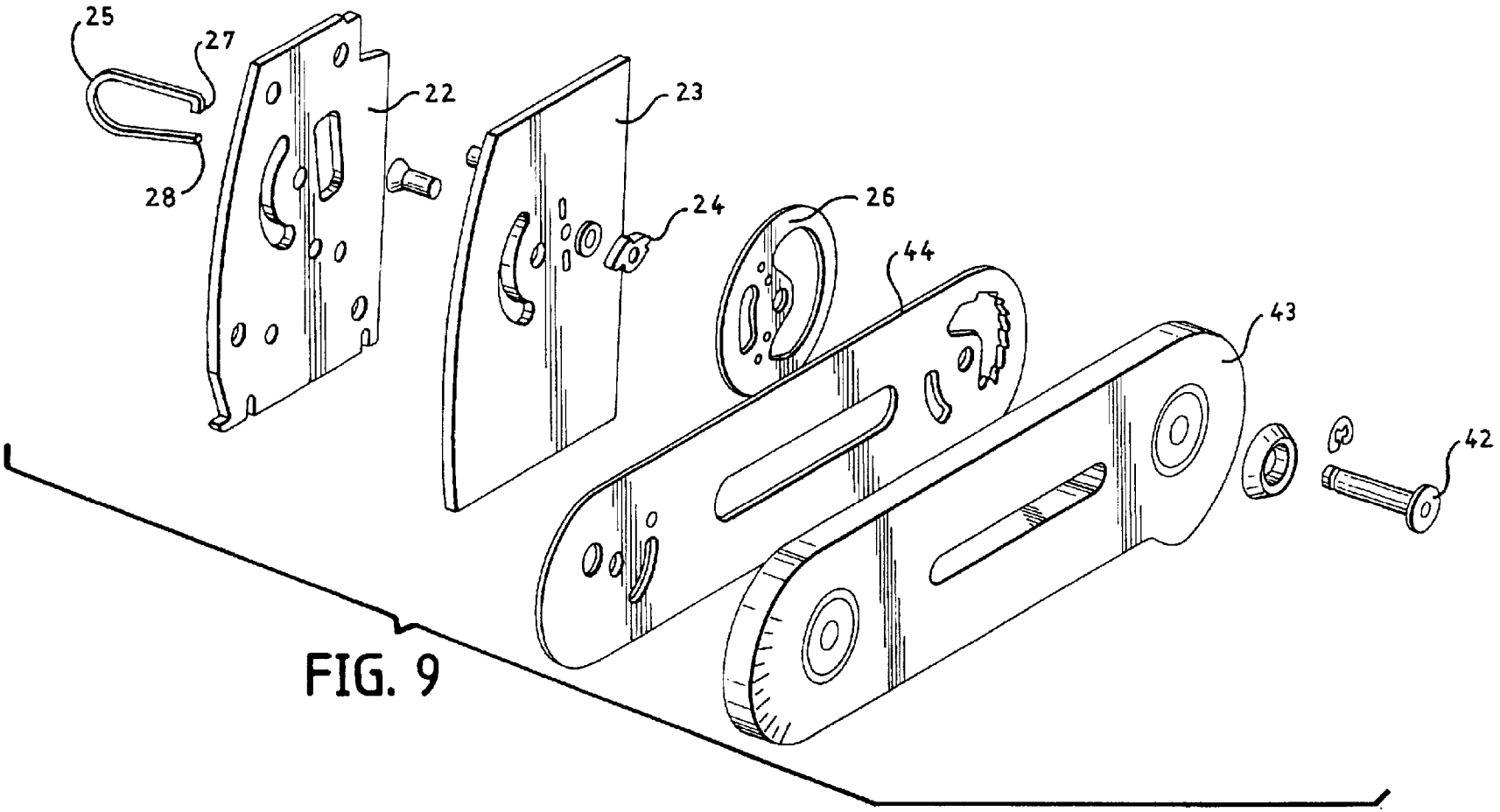
FIG. 9 is an exploded view of the ratchet and pawl mechanism between the support arm and side wall of the ballast housing of the present invention.

As seen in FIG. 8, the support mount plate 23, which is mounted on the end of the ballast housing 20 adjacent the ballast housing side wall 22, allows the pawl 24 to rotate about a center pivot point. Once the pawl 24 is in the position depicted in FIG. 8, the reflector housing 30 may be lowered to the lower most position as shown in FIG. 5*b* which causes the pawl 24 to engage the closing ratchet 49 thereby forcing the pawl to rotate and the pawl tooth 39 outward to engage ratchet teeth 47. Continued clockwise rotation of the reflector housing 30 about the hinge pin 42 allows the reflector housing to be supported in predefined increments depending on the position of the ratchet teeth 47 within the support arm 41.

Figure 10:
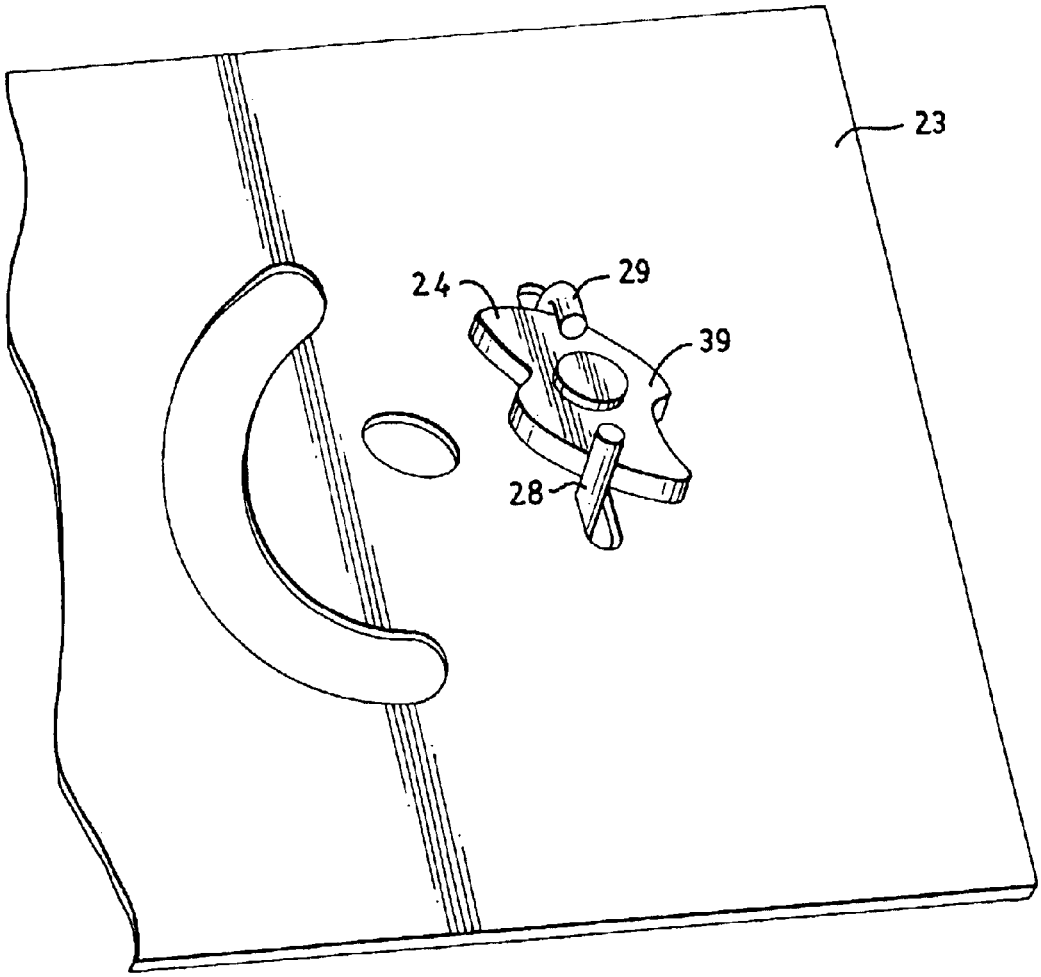
FIG. 10 is a close up view of the pawl assembly of the present invention showing the pawl in the engaged position; and, FIGS. 11, 11*a* and 11*b* is a partial perspective view of the present invention detailing the light leveler and adjustment of the head angle for the reflector housing of the present invention.

As shown in FIG. 8 and FIG. 10, the pawl bias clip 25 allows for the pawl to be held or maintained in the unengaged position thereby allowing the reflector housing 30 to be reset and rotated counterclockwise about hinge pin 42. Biasing clip 25, as shown in FIG. 6, may extend through the ballast housing side wall 22 and support mount plate 23 such that the ends engage the pawl 24. However, a number of biasing mechanisms are well known in the art for properly biasing a pawl against a ratchet area or ratchet wheel. Further, the exact configuration of the ratchet and pawl mechanism depicted within the figures is not considered to be narrowing in scope as modifications to the pawl and ratchet assembly are considered to be covered that incorporated by the teachings herein. Thus, various constructions of ratchet and pawl mechanisms used in conjunction with the support arms and housing members are felt to be incorporated within the teachings hereof.

Figure 11:
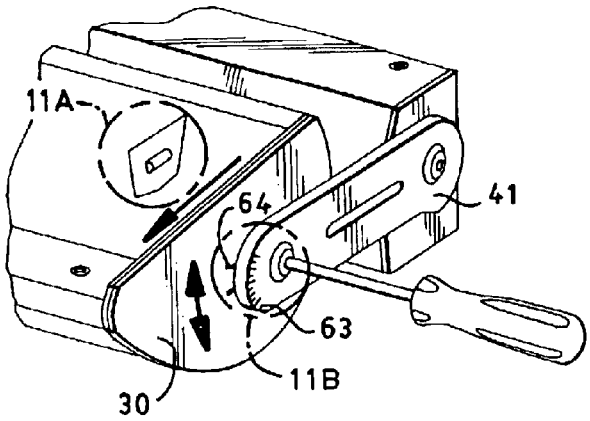

The ratchet and pawl mechanism configuration integrated within the support arm 41 described herein may be provided on a single support arm or on both support arms 40, 41 dependent upon the functionality required for support of the reflector housing. Thus, where heavier reflector housings 30 are present, it may be necessary to provide a secondary support mechanism. The support arm design which incorporates the ratchet and pawl mechanism allows for an additional method for adjusting the angle of deflection of light emitted from the reflector housing 30 in addition to altering the deflection of the actual reflector previously mentioned. Additionally, as shown in FIG. 3, pin 62 may also be loosened thereby allowing rotation of the reflector housing 30 about pin 62 on support arm 41. An additional pin may be provided on support arm 40 on the opposite side. Thus, as shown in FIGS. 11 and 11*b*, markings 63 on the support arm 41 may provide additional adjustment of the reflector housing 30 in addition to the adjustment of the reflector and adjustment of the support arms 41 in relationship to the ballast housing 20. Thus, the design of the present invention allows for three different angular adjustments of the light emitted from the reflector housing 30 depending upon the end users needs and ultimate configuration.

As depicted in the figures, the ballast electronics are connected to the lamp by ballast feed wire 45. As seen, the ballast feed wires are positioned from the ballast housing 20 through the support arm 41 such that they are not evident on the exterior of the indirector light fixture 10 of the present invention. Thus, inner plate 44 and outer plate 43 of support arm 41 provide a hollow space through which the ballast feed wire 45 may be threaded such that the feed wires 45 extend from the ballast housing 20, through the interior of support arm 41 between inner plate 44 and outer plate 43 and into the interior of the reflector housing 30 such that adequate current may be provided to lamp 30 through lamp socket 36*a*. The ballast feed wires are more readily shown in FIGS. 7 and 8 as the feed wires are threaded through the support mount plate 23 into the interior of the support arm 41. As shown in FIG. 6, the feed wires are additionally fed back through the inner plate 44 to the interior of the reflector housing 30 such that the ballast feed wires never are positioned on the exterior of any of the structure of the fixture 10. Thus, the feed wires 45 are contained entirely within the interior of the fixture thereby providing easier connection and installation of the entire fixture 10. As indicated, such a design is possible by having the interior of the support arm 41 formed between the inner plate 44 and outer plate 43 such that the wires may be fed therethrough although alternative constructs may be used to accomplish the same effect.

The indirector light fixture 10 of the present invention as described herein and shown in the drawings therefore has a plurality of mechanisms through which the reflector housing 30 may be adjusted. The reflector 34 may be adjusted within the internal construct of the reflector housing 30 by adjusting the reflector adjustment screws 35 thereby allowing the biasing springs 35*a* to raise or lower the reflector 34 within the housing 30. Alternatively, the entire reflector housing 30 and support arms 40, 41 may be raised or lowered and supported in position by a ratchet and pawl mechanism. However, a number of known support mechanisms for retaining the support arms 40, 41 in position may be utilized thereby to prevent additional rotation of the support arms relative to the mounted ballast housing 20. Additionally, the reflector housing may be further positioned relative to the housing pin 62, shown in FIG. 3, such that the housing is further aligned to the proper head angle required by the end user.

Figure 11A:
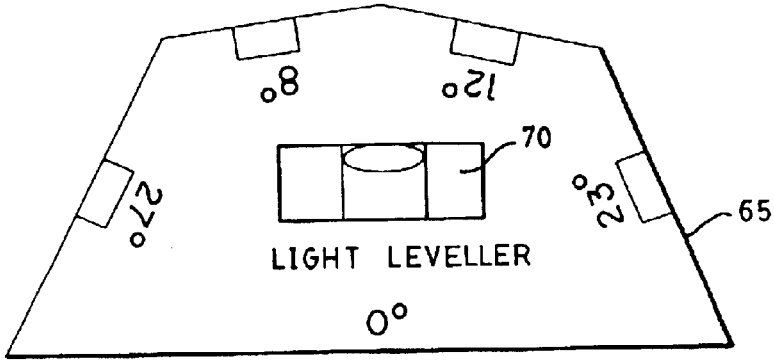
Figure 11B:
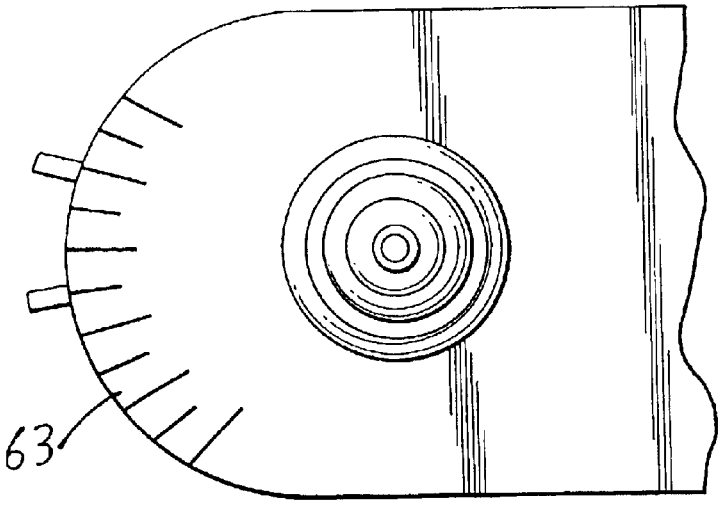

As shown in FIGS. 11 and 11*a*, the fixture 10 of the present invention may be equipped with a light leveler 65 as shown and indicated. The leveler 65 may have angular measurement sides with a level bubble 70 formed therein. As shown in the drawing, the sides may have markings and are formed at differing angles such that the reflector angle may be properly adjusted upon installation. Thus, as indicated, the reflector 30 may be properly adjusted for either short or long throw positions at 0°, 8° or 12° from horizontal when the ballast housing is mounted to a wall or other vertical surface. Alternatively, when a ceiling mount is utilized, it may be desirable to adjust to 23° or 27° from vertical for angular mounting. The bubble 70 in conjunction with the sides of the leveler being at the desired angular orientation allows for the proper adjustment of the reflector housing 30. The use of the leveler 65 in combination with the fixture of the present invention aides in the proper installation of the fixture relative to the various surfaces and allows relative ease of installation for both ceiling and wall mount.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the amended claims.

We claim:

1. A light fixture, comprising:

a reflector housing and a ballast housing;

at least one support arm affixed to said ballast housing and said reflector housing;

a reflector and a lamp positioned within said reflector housing;

a ratchet and pawl mechanism interposed between said at least one support arm and said ballast housing;

said at least one support arm having a ratcheting adjustment at said ballast housing and pivotal adjustment at said reflector housing.

2. The light fixture of claim 1 wherein said support arm has a plurality of ratchet teeth formed on a first distal end, said ratchet teeth engaging a pawl on said ballast housing.

3. The light fixture of claim 2 wherein said pawl is rotatably positioned on an external surface of a side wall of said ballast housing.

4. The light fixture of claim 3 further comprising a pawl biasing clip extending through said side wall and engaging said pawl.

5. The light fixture of 3 wherein said support arm is further comprised of an inner plate and an outer plate, said ratchet teeth formed on said inner plate.

6. The light fixture of claim 5 further comprising at least one ballast feed wire extending from said ballast housing to said reflector housing, said ballast feed wire extending through an interior area of said support arm between said inner plate and said outer plate.

7. The light fixture of claim 1 wherein said support arm has an inner plate and an outer plate, said light fixture having a ballast feed wire extending from said ballast housing to said reflector housing, said ballast feed wire extending from said ballast housing, through said support arm between said inner plate and said outer plate and into said reflector housing.

8. The light fixture of claim 1 wherein said reflector is connected to said reflector housing by at least one hinge and further comprising a reflector adjustment screw extending through said reflector and through a biasing spring, said biasing spring biasing said reflector about said hinge.

9. The light fixture of claim 1 wherein said ballast housing has a ballast housing side wall, said ratchet and pawl mechanism being a pawl rotatably connected to said housing side wall, said support arm having an inner surface, said inner surface having a plurality of ratchet teeth formed thereon, said pawl and ratchet teeth operably engageable.

10. The light fixture of claim 9 further comprising a pawl biasing spring extending through said ballast housing side wall and having a first end and a second end, said first end engaging a first side of said pawl, said second end engaging a second side of said pawl.

11. A position adjustable light fixture, comprising:

a reflector housing pivotally connected to a ballast housing by at least one support arm;

said support arm being adjustable at a first end by a ratchet and pawl mechanism and pivotally adjustable at a second end;

a reflector within said reflector housing partially surrounding a lamp;

a ballast feed wire extending from said ballast housing to said reflector housing through an interior area of said support arm.

12. The light fixture of claim 11 further comprising a pawl rotatably affixed to a side wall of said ballast housing, said support arm having a plurality of ratchet teeth engageable with said pawl.

13. The light fixture of claim 12 further comprising a pawl biasing clip extending through said side wall of said ballast housing and having a first end and a second end contacting said pawl.

14. The light fixture of claim 11 farther comprising a ratchet and pawl mechanism engageable between said support arm and said ballast housing.

15. The light fixture of claim 14 wherein said ratchet and pawl mechanism is a rotatable pawl engageable with a plurality of ratchet teeth.

16. The light fixture of claim 15 wherein said ratchet teeth and said rotatable pawl provide a means for rotating said reflector housing counterclockwise in predefined increments.

17. The light fixture of claim 15 wherein said rotatable pawl is rotatably affixed to a sidewall of said ballast housing, said ratchet teeth formed on an inner plate of said support arm.

18. The light fixture of claim 11 further comprising:

at least one binge connecting said reflector to said reflector housing;

at least one reflector adjustment screw extending through said reflector and a biasing spring;

a ratchet and pawl mechanism interposed between said support arm and said ballast housing.

19. A position adjustable light fixture, comprising:

a ballast housing and a reflector housing at least one support arm having a pivotal connection with said reflector housing and having a ratcheting connection to said ballast housing;

a reflector hingedly connected to said reflector housing;

a ballast feed wire extending from inside said ballast housing to said reflector housing;

said support arm having a hollow interior, said ballast feed wire extending through said hollow interior of said support arm and not positioned external of said light fixture.

20. The light fixture of claim 19 further comprising a ratchet and pawl mechanism formed on said support arm.

21. The light fixture of claim 20 wherein said ratchet and pawl mechanism is a pawl rotatably affixed to a side wall of said ballast housing, a spring extending through said side wall and having a first and a second end engaging said pawl, a plurality of ratchet teeth formed on an inner surface of said support arm.

22. An adjustable light fixture, comprising:

a ballast housing and a reflector housing having an interposed support arm;

a ratchet and pawl mechanism for allowing said reflector housing to rotate clockwise in predefined increments and be maintained in position and also allowing said reflector housing to be reset in a lower position;

a pivotal connection between said support arm and said reflector housing;

a ballast feed wire extending from said ballast housing to said reflector housing through an interior of said support arm;

an adjustable reflector within said reflector housing.

23. An adjustable light fixture, comprising:

a first housing supporting a reflector housing, said first housing having a support arm rotatably attached thereto, said support arm rotatably attached to said reflector housing;

a plurality of ratchet teeth formed on said support arm and engaging a pawl affixed to said first housing;

said reflector housing pivotally connected to said support arm;

a feed wire extending from said first housing to said reflector housing.

* * * * *